United States Patent [19]

Metrosky

[11] Patent Number: 4,973,054

[45] Date of Patent: Nov. 27, 1990

[54] PORTABLE BACKBOARD AND HOOP ASSEMBLY

[76] Inventor: John J. Metrosky, R.R. 1, Box 111, Allentown, N.J. 08501

[21] Appl. No.: 491,953

[22] Filed: Mar. 12, 1990

[51] Int. Cl.[5] ..... A63B 63/08
[52] U.S. Cl. ..... 273/1.5 R
[58] Field of Search ..... 273/1.5 R, 1.5 A, 407

[56] References Cited

U.S. PATENT DOCUMENTS

| | | | |
|---|---|---|---|
| 2,517,463 | 8/1950 | Cobb | 273/1.5 R |
| 3,622,155 | 11/1971 | Hirsch | 273/1.5 R |
| 4,715,599 | 12/1987 | Raymond et al. | 273/1.5 R |
| 4,762,319 | 8/1988 | Krumholz | 273/1.5 R |
| 4,934,696 | 6/1990 | Jackan | 273/1.5 R |

OTHER PUBLICATIONS

Toys to Grow on Catalog, 10–1988, Dirty Dunk Laundry Shoot.

*Primary Examiner*—Paul E. Shapiro
*Attorney, Agent, or Firm*—William L. Muckelroy

[57] ABSTRACT

A portable basketball backboard and hoop assembly attachable to a variety of structures comprising, in combination, a backboard; a hoop fixedly attached to the background; a substantially square tubular frame member selectively attachable to the backboard at various angular dispositions, said frame member having a cross bar horizontally disposed between the respective sides of said frame member and an engagement loop fixedly attached to the top horizontal portion of said frame member; and a variety of structural attachments for attachment of the assembly to various structures including a door, a wall, a door jamb, a post or pole, a free-standing A-frame and a swimming pool diving board.

11 Claims, 5 Drawing Sheets

PORTABLE BACKBOARD AND HOOP ASSEMBLY

BACKGROUND OF THE INVENTION

The present invention generally relates to a backboard and hoop assembly for playing the game of basketball. More specifically, the present invention relates to a portable basketball backboard and hoop assembly that can be selectively attached to a plurality of structures.

The game of basketball is widely enjoyed and a basketball court can be found at most gymnasiums or playgrounds. However, it is often desired to play basketball away from a gymnasium or playground court, including in swimming pools and at remote locations, and a portable, easily erected backboard and hoop that can be assembled and attached to a variety of structures has not been identified by the Applicant. Various basketball hoop assemblies have been disclosed in the prior art, however these assemblies do not provide the versatility and easy transportability necessary for a commercially marketable portable backboard and hoop assembly attachable to a variety of structures. For examples, a basketball backboard and hoop attachable to a roof is disclosed in U.S. Pat. No. 3,414,262 to Lounsbury which provides an adjustable bracket for attachment to roofs of various slopes; U.S. Pat. No. 2,144,148 to Gross and U.S. Pat. No. 2,227,310 to Hoppes et al. disclose portable basketball backstops supported by multi-component frames; U.S. Pat. No. 2,818,254 to Dunn, U.S. Pat. No. 3,743,286 to Weinhagen et al. and U.S. Pat. No. 4,613,136 to Raba et al. disclose poolside basketball apparatuses; and U.S. Pat. No. 4,715,599 to Raymond et al. and U.S. Pat. No 4,717,150 to Pribnow disclose basketball backboard and hoop assemblies attachable to a swimming pool diving board. An attachment to support a basketball hoop on a seat of gymnasium bleachers is disclosed in U.S. Pat. No. 4,771,973 to Kohlman et al.

While the above-mentioned apparatuses provide means to erect a basketball backboard and hoop in various locations, none of the prior art references provides a easily transportable backboard and hoop assembly that can be selective attached to a plurality of structures. Furthermore, the basketball backboard and hoop apparatuses of the prior art are either fixedly or rigidly attached to its supporting structure and thus may be damaged when struck during play. Spring-biased pivotally-mounted hoops are known in the prior art which disengage from the upright position when struck during play, but no prior art means have been identified by the Applicant for resilient or flexible support of a backboard to prevent damage to the support structure when the backboard is struck during play.

SUMMARY OF THE INVENTION

The basketball backboard and hoop assembly of the present invention comprises, in combination, a substantially square tubular frame member having a horizontal cross bar extending between the sides of said frame member and an engagement loop fixedly attached to the top horizontal portion of said frame member; a backboard having a cross bar clip fixedly attached to the rear surface of said backboard which selectively engages the cross bar of said frame member; a basketball hoop and net fixedly attachable to said backboard; means to mount said frame member at various angular dispositions with said backboard and hoop; and a variety of structure attachment means including one or a plurality of bungie cords, a pair of S-shaped hooks, a pair of bicycle hooks, a pair of over-the-door hooks, a post hook and a pair of wall attachment hooks. The various attachment means of the present invention are selectively utilized to attach the backboard, hoop and frame member to a variety of structures.

An object of the present invention is to provide a basketball backboard and hoop assembly that can be attached to a variety of structures including a vertical pole or post, a doorway, a door, a wall, a free-standing frame and a swimming pool diving board.

Another object of this invention is to provide a basketball backboard and hoop assembly that can be easily transported by the user.

Another object of this invention is to provide a basketball backboard and hoop assembly that can be efficiently packed and shipped by the manufacturer.

It is also an object of this invention to provide a simple construction for a basketball backboard and hoop.

A further object of the present invention is to provide a basketball backboard and hoop assembly that can be erected in remote areas with minimum assemblage.

A still further object of this invention is to provide a backboard and hoop assembly that can be resiliently attached to a plurality of structures to thereby prevent damage that would otherwise result when a rigidly or fixedly attached backboard and hoop is struck during play.

These and other objects and advantages of the present invention will be apparent to those skilled in the art from the following description of a preferred embodiment, claims and appended drawings.

DESCRIPTION OF PREFERRED EMBODIMENTS

Figure 1:
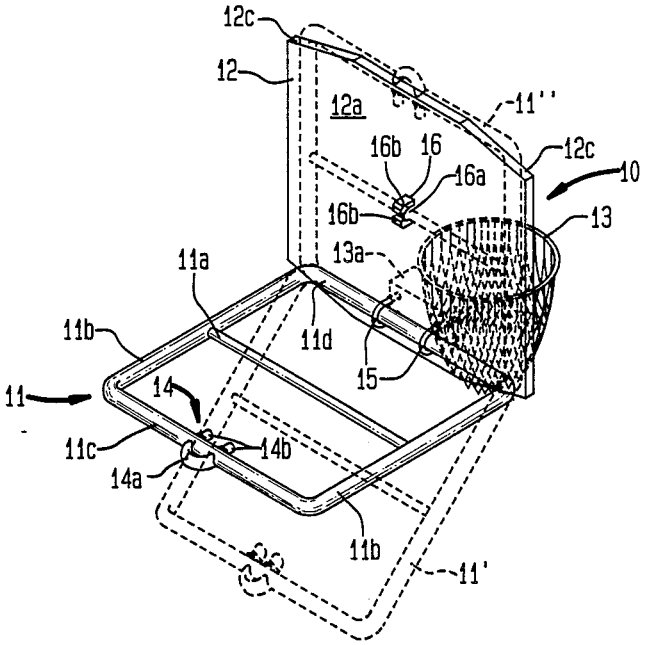
FIG. 1 is a rear perspective view of the basketball backboard and hoop assembly of the present invention showing various angular dispositions of the frame member.
Figure 2:
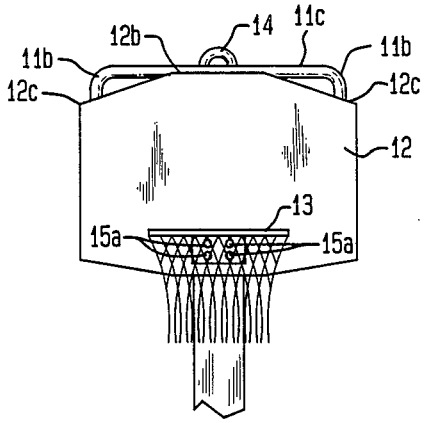
FIG. 2 is a front plan view of the backboard and hoop assembly of the present invention shown with the frame member in its vertical disposition.

FIG. 1 illustrates in a rear perspective view the frame member 11, backboard 12 and netted hoop 13 of the basketball backboard and hoop assembly 10 of the present invention. The frame member 11 is a substantially square tubular frame having a cylindrical cross bar 11*a* extending horizontally between the respective side portions 11*b* of said frame member 11 and an engagement loop 14 fixedly attached to the top horizontal portion 11*c* of said frame member 11. Engagement loop 14 is preferably a U-bolt 14*a* having threaded ends which extend through the top horizontal portion 11*c* of said frame member 11 to dispose the curved portion of the U-bolt 14*a* above said top portion 11*c*, said U-bolt 14*a* being fixedly attached to said top portion 11*c* by means of complimentarily threaded U-bolt nuts 14*b*. Frame member 11 can be fixedly attached to the lower portion of the rear surface 12*a* of said backboard 12 at various selective angular dispositions by means of a pair of frame mount U-bolts 15 which fit about the bottom horizontal portion 11*d* of said frame member 11, said frame mount U-bolts 15 having threaded ends and being fixedly attachable to said backboard 12 by means of complementarily threaded frame mount bolt nuts 15*a* (FIG. 2). The frame mount U-bolts 15 extend through said backboard 12 and the support frame 13*a* of said hoop 13 thereby providing means to mount said hoop 13 to said backboard 12 in conjunction with providing means for mounting said frame member 11 to said backboard 12.

As previously mentioned, the frame member 11 can be fixedly attached to the backboard 12 at various angular dispositions. In FIG. 1 two such dispositions are illustrated by the phantom diagrams of said frame 11 indicated by the numerals 11' and 11''. The varying dispositions of frame member 11 are utilized for attachment of the backboard and hoop assembly 10 to various structures as hereinafter described in greater detail. The disposition of frame member 11 indicated in FIG. 1 by the numeral 11' corresponds to the positioning of the frame member 11 for attachment of the assembly 10 to a swimming pool diving board; the disposition indicated by the numeral 11'' illustrates the vertical positioning of frame member 11 adjacent to backboard 12 for attachment of the assembly 10 to a door, door jamb, wall, post, or a free-standing frame support.

Backboard 12 includes a cross bar clip 16 fixedly attached to the rear surface 12*a* of said backboard 12 which engages the cross bar 11*a* of said frame member 11 when said frame member 11 is raised to the vertical position indicated by the numeral 11''. Cross bar clip 16 is substantially a C-shaped member preferably formed from a resilient metal or dense plastic material having opposing, inwardly extending clip lips 16*a* integrally formed with the arms 16*b* of said clip 16, said cross bar 11*a* selectively attaching to said clip lips 16*a* in snap-fit engagement.

In FIGS. 1 and 2 it can be seen that the backboard 12 is formed having a top edge 12*b* with downwardly extending corners 12*c*. When the frame member 11 is disposed in its vertical position 11'' the top horizontal portion 11*c* of said frame member 11 extends above the corners 12*c* of said backboard 12 thereby providing an unencumbered juncture of the respective side portions 11*b* of said frame member 11 and the top portion 11*c* of said frame member 11 which facilitates attachment of said assembly 10 to a free-standing A-frame as hereinafter described in greater detail.

Figure 3:
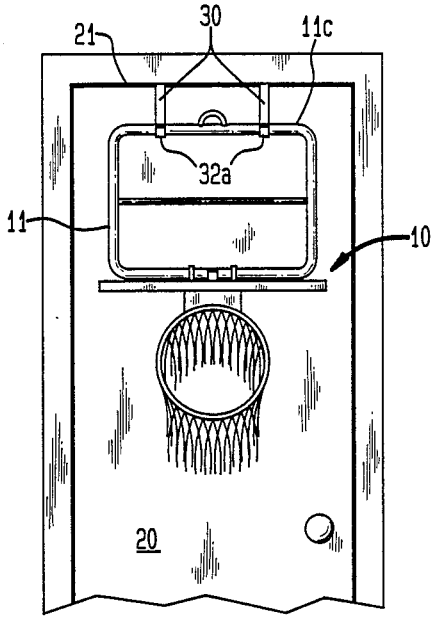
FIG. 3 is a front plan view of the present invention shown in an open position attached to a door.
Figure 4:
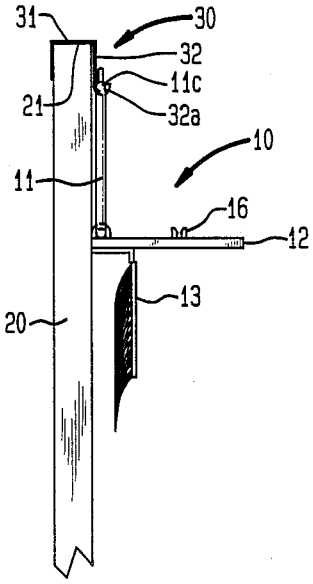
FIG. 4 is a side plan view of the present invention as shown in FIG. 3.

Referring now to FIGS. 3 and 4 there is shown the attachment of the backboard and hoop assembly 10 of the present invention to a door 20. FIG. 3 illustrates a front plan view with the assembly 10 shown in its open position and FIG. 4 illustrates a side plan view of the assembly 10 as shown in FIG. 3. A pair of over-the-door hooks 30 are disposed over the top edge 21 of the door 20 in spaced relationship and engage the lower edge of the top portion 11*c* of said frame member 11 for bearing support of said assembly 10. Said over-the-door hook 30 is formed having a substantially inverted U-shaped upper portion 31 integrally formed with an L-shaped lower portion 32 having a convexly-curved foot 32*a*. The upper portion 31 of said hook 30 engages the top edge 21 of the door and the foot 32*a* of said lower portion 32 receives the top portion 11*c* of said frame member 11.

Figure 5:
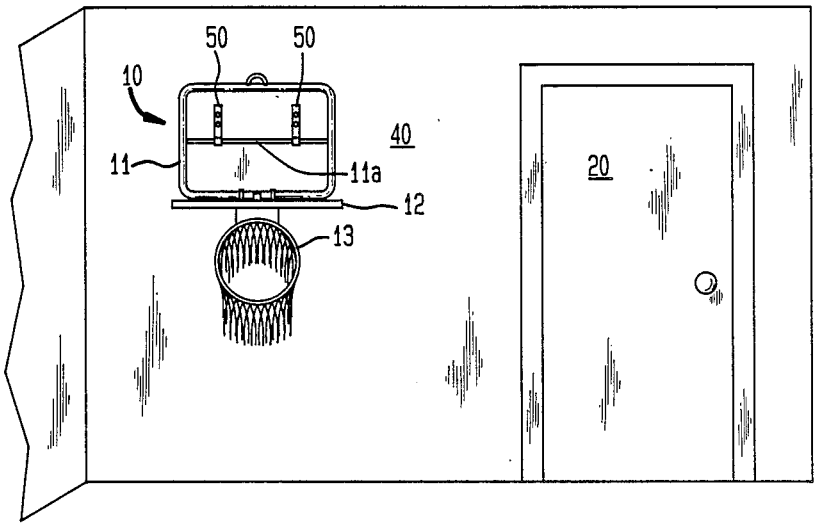
FIG. 5 is a front plan view of the present invention shown in an open position attached to a wall.
Figure 6:
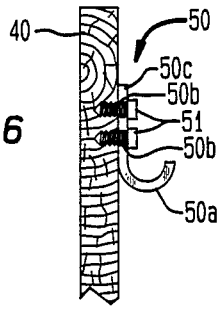
FIG. 6 is a side plan view of the wall attachment hook of the present invention.

FIG. 5 illustrates in a front plan view the attachment of the backboard and hoop assembly 10 of the present invention to a wall 40. A pair of wall attachment hooks 50 are fixedly attached to the wall 40 and engage the cross bar 11*a* of said frame member 11 in bearing engagement to support said assembly 10. As can be best seen in the side plan view of the wall hook 50 illustrated in FIG. 6, the wall attachment hook 50 is substantially an L-shaped member having a convexly-curved foot 50*a* which engages the cross bar 11*a* of said frame member 11 (FIG. 5). Screw openings 50*b* are formed in the vertically extending leg 50*c* of said wall hook 50 for receipt of wall screws 51 which attach to the wall 40 for mounting of said wall attachment hook 50 thereto.

Figure 7:
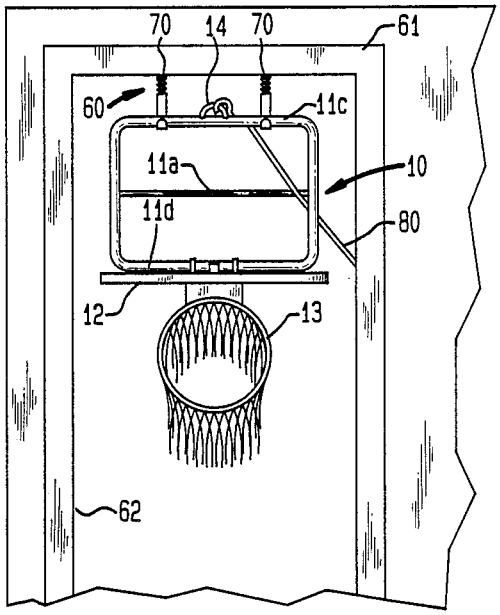
FIG. 7 is a front plan view of the present invention shown in an open position attached to a door jamb.
Figure 8:
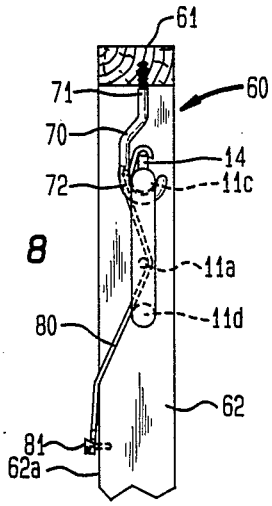
FIG. 8 is a side plan view of the present invention as shown n FIG. 7.
Figure 9:
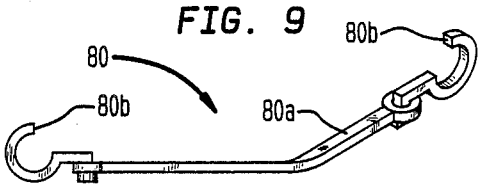
FIG. 9 is a perspective view of the bungie cord of the present invention.

FIG. 7 illustrates in a front plan view the attachment of the backboard and hoop assembly 10 of the present invention to a door jamb 60. A pair of bicycle hooks 70 are provided which screw into attach to the top horizontal portion 61 of the door jamb 60 in spaced relationship and engage the lower edge of the top portion 11*c* of the frame member 11 in bearing engagement to support said assembly 10. One end of a bungie cord 80 is attached to the engagement loop 14 of said frame member 11 and the opposite end of said bungie cord 80 is attached to bungie cord support 81 fixedly attached to the rearward face 62*a* of a side vertical portion 62 of said door jamb 60 proximate to the lower end of said door jamb vertical portion 62 (FIG. 8). As can be best seen in the side plan view of the door jamb attachment shown in FIG. 8, the bicycle hook 70 includes a threaded and pointed hook head 71 which engages the top portion 61 of the door jamb 60 by screw attachment directly into said top portion 61, and a curved hook foot 72 which engages the lower edge of the top portion 11*c* of the frame member 11 in bearing engagement to support said backboard and hoop assembly 10. As can be also seen in FIG. 8 the bungie cord 80 engages the engagement hook 14 of said frame member 11 and extends across the rearpart of the top portion 11*c* of said frame member 11, across the forepart of the cross bar 11*a* of said frame member 11, and across the rearpart of the bottom portion 11*d* of said frame member 11 to said bungie cord support 81. This attachment of said bungie cord 80 provides resilient support of said assembly 10. A perspective view of the bungie cord 80 is illustrated in FIG. 9 where it can be seen that said bungie cord 80 comprises a length of dense elastic material 80*a* having bungie hooks 80b fixedly attached at each end of said length of elastic 80a. In the door jamb attachment previously described, the bungie hooks 80b respectively engage the engagement hook 14 and the bungie support 81.

Figure 10:
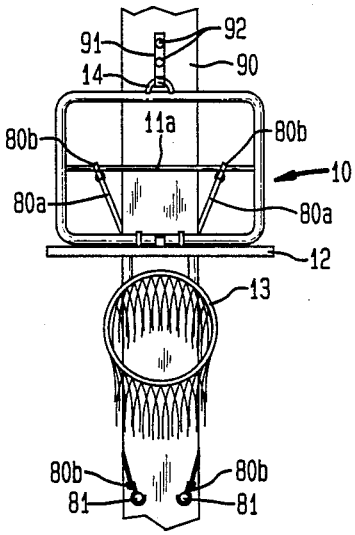
FIG. 10 is a front plan view of the present invention shown in an open position attached to a pole.
Figure 11:
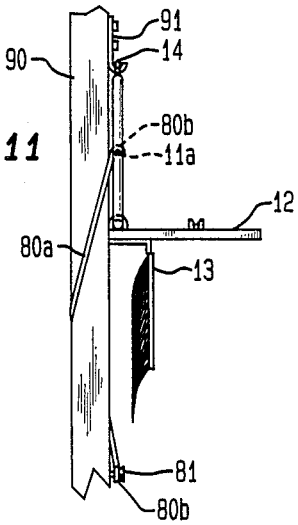
FIG. 11 is a side plan view of the present invention as shown in FIG. 10.

FIGS. 10 and 11 illustrate the attachment of the backboard and hoop assembly 10 of the present invention to a vertical post or pole 90. A post hook 91 is fixedly attached to the post 90 by screw means 92 and said post hook 91 engages the engagement loop 14 of said frame member 11 for bearing support of said assembly 10. The bungie hooks 80b of a pair of bungie cords 80 are disposed in spaced relationship to each side of said post 90 and engage the cross bar 11a of said frame member 11 at one end thereof. The lengths of dense elastic 80a extend therefrom to wrap around said post 90 to permit the engagement of the bungie hooks 80b disposed at the opposite end of said dense elastic 80a to respective bungie supports 81 fixedly attached to the opposite sides of said post 90 below said assembly 10.

Figure 12:
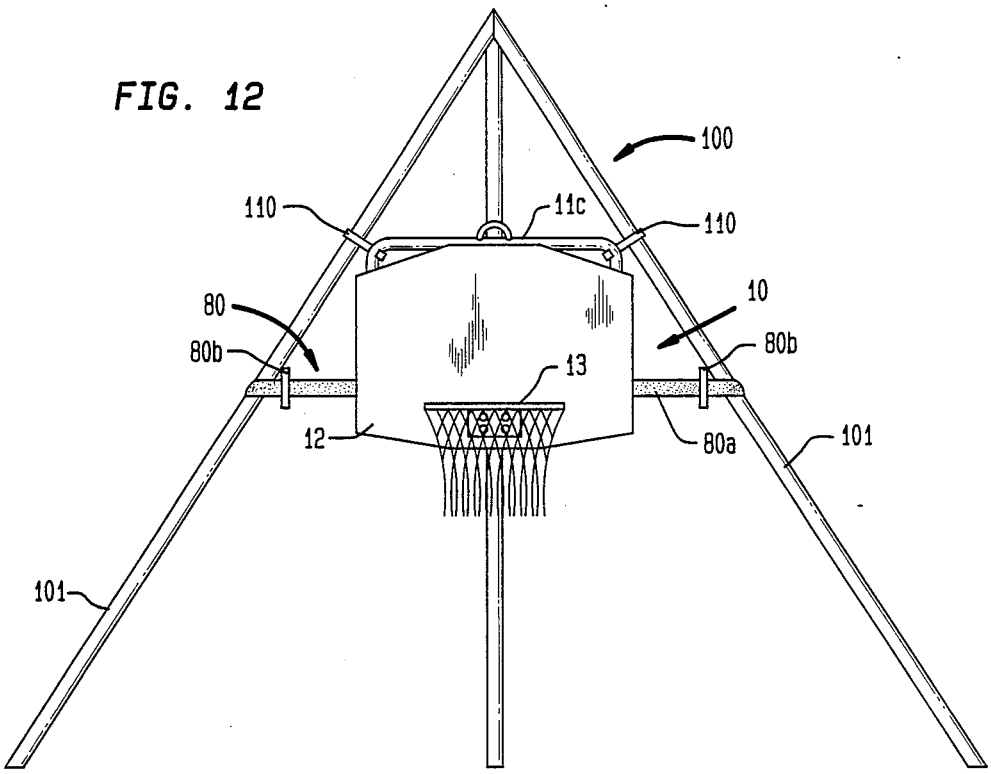
FIG. 12 is a front plan view of the present invention shown in a closed position attached to an A-frame.
Figure 13:
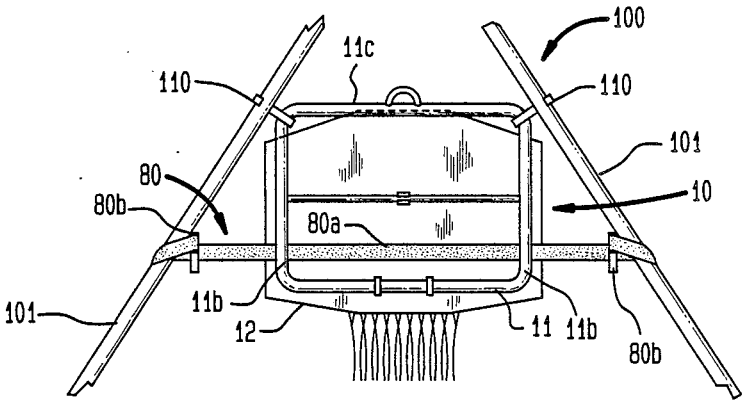
FIG. 13 is a fragmented rear plan view of the present invention as shown in FIG. 12.

FIG. 12 illustrates in a front plan view the attachment of the backboard and hoop assembly 10 of the present invention to a free-standing A-frame 100. In FIG. 13 a fragmented rear plan view of the attachment of the A-frame 100 and backboard and hoop assembly 10 is shown. A pair of S-hooks 110 engage the junctures of the top portion 11c and the respective side portions 11b of the frame member 11 at one end, and at the opposite end said S-hooks 110 engage the forward legs 101 of said A-frame 100. A bungie cord 80 extends horizontally across the lower portion of the backboard 12 of said assembly 10 between said backboard 12 and the tubular frame member 11, the ends of the length of dense elastic 80a being wrapped around the forward legs 101 of said A-frame 100 and the respective bungie hooks 80b engaging the dense elastic 80a.

Figure 14:
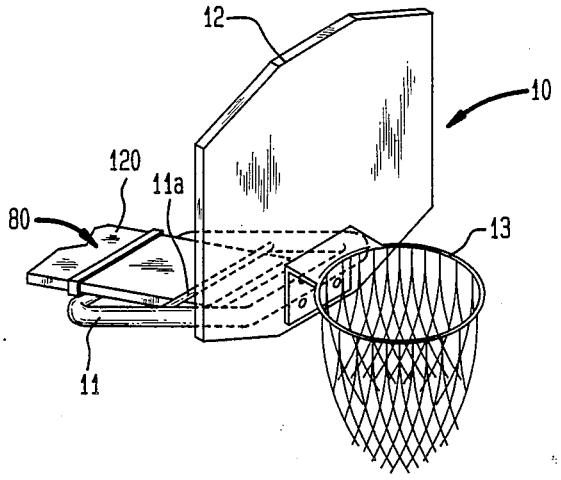
FIG. 14 is a side perspective view of the present invention shown attached to a swimming pool diving board.
Figure 15:
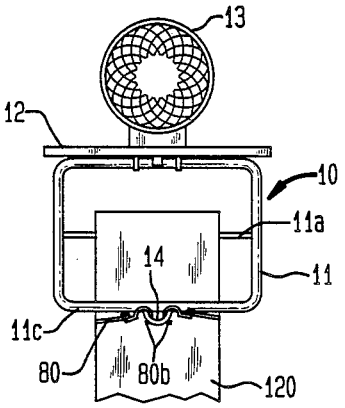
FIG. 15 is a bottom plan view of the present invention as shown in FIG. 14.

FIGS. 14 and 15 illustrate the attachment of the backboard and hoop assembly 10 of the present invention to a swimming pool diving board 120 to provide means for the play of a basketball game in a swimming pool. In the perspective view of the diving board attachment shown in FIG. 14 it can be seen that for attachment of the assembly 10 to a diving board 120 the frame member 11 is disposed angularly downward from the backboard 12 and hoop 13 as previously described and indicated by 11' in FIG. 1. The top portion 11c of said frame member 11 is disposed adjacently below said diving board 120 and the cross bar 11a is disposed adjacently above said diving board 120. A bungie cord 80 extends about said diving board 120 having the bungie hooks 80b engaged in the engagement loop 14 of the frame member 11 as can be seen in the bottom plan view of the diving board 120 shown in FIG. 15. This attachment of the assembly 10 to the diving board 120 provides means for resilient engagement of the assembly 10 with the diving board 120 such that when the backboard 12 and hoop 13 are struck upwardly during play the assembly 10 will automatically return to its seated position upon the diving board 120 thereby preventing damage to the backboard 12 or hoop 13 that would otherwise result if the assembly 10 was rigidly attached to the diving board 120.

From the foregoing it can be seen that the backboard and hoop assembly 10 of the present invention provides a simple construction for a backboard 12 and hoop 13 that can be attached to a variety of structures. Various changes, modifications and additions may be made to the present invention as described for the various preferred embodiments without departing from the spirit and scope of the present disclosure and such changes, modifications and additions are intended to be included in the present invention as held in the appended claims.

Therefore in view of the foregoing, I claim:

1. A backboard and hoop assembly comprising, in combination, a substantially square frame member having a cross bar extending between the vertical side portions of said frame member and an engagement loop fixedly attached to the top horizontal portion of said frame member;

a backboard having a cross bar clip fixedly attached to the rear face of said backboard which selectively engages the cross bar, the top edge of said backboard having downwardly extending corners disposed below the top horizontal portion of said frame member;

a basketball hoop and net having a hoop support frame fixedly attached to the front face of said backboard;

means to fixedly mount said frame member at various angular dispositions relative to said backboard by pivotal attachment of the bottom horizontal portion of said frame member to said backboard, said frame mounting means further providing means to fixedly attach said hoop to said backboard; and means to attach said frame member, backboard and hoop to a structure.

2. A backboard and hoop assembly as described in claim 1 wherein said cross bar clip comprises a substantially C-shaped member having opposing clip lips integrally formed with and extending inwardly from the arms of said clip, said clip lips engaging the cross bar of said frame member in snap-fit engagement.

3. A backboard and hoop assembly as described in claim 1 wherein said frame mounting means comprises paired, threaded end U-bolts which fit about the bottom horizontal portion of said frame member in spaced relationship and extend through said backboard and hoop support frame, said U-bolts being fixedly attachable thereto by means of complementarily threaded U-bolt nuts.

4. A backboard and hoop assembly as described in claim 1 wherein said means to attach said frame member, backboard and hoop to a structure comprises a pair of over-the-door hooks disposed in spaced relationship, each hook having a substantially inverted U-shaped upper portion integrally formed with an L-shaped lower portion having a convexly-curved foot, the upper portion engaging the top edge of a door and the lower portion engaging the top horizontal portion of said frame member, thereby providing means to attach said backboard and hoop assembly to a door.

5. A backboard and hoop assembly as described in claim 1 wherein said means to attach said frame member, backboard and hoop to a structure comprises a pair of wall attachment hooks disposed in spaced relationship and fixedly attached to a wall which engages the cross bar of said frame member in bearing engagement thereby providing means to attach said backboard and hoop assembly to a wall.

6. A backboard and hoop assembly as described in claim 1 wherein said means to attach said frame member, backboard and hoop to a structure comprises a pair of bicycle hooks disposed in spaced relationship which screw into the top horizontal portion of a door jamb and engage the top horizontal portion of said frame member in bearing engagement and a bungie cord having one end attached to the engagement loop of said frame member and the opposite end attached to a bungie cord support fixedly attached to the vertical portion of said door jamb below said assembly, thereby providing means to attach the backboard and hoop assembly to a door jamb.

7. A backboard and hoop assembly as described in claim 1 wherein said means to attach said frame member, backboard and hoop to a structure comprises a post hook fixedly attached to a vertical post or pole and a pair of bungie cords disposed in spaced relationship to each side of said post or pole which fixedly engage the cross bar at one end of each bungie cord and at the opposite end of each bungie cord fixedly engage respective bungie cord supports fixedly attached to said post or pole below said assembly, thereby providing means to attach said backboard and hoop assembly to a vertical post or pole.

8. A backboard and hoop assembly as described in claim 1 wherein said means to attach said frame member, backboard and hoop to a structure comprises a pair of S-hooks which engage the junctures of the top horizontal portion and the respective side portions of said frame member at one end thereof and the respective forward legs of a free-standing A-frame at the opposite end of said S-hooks and a bungie cord extending horizontally between said backboard and said frame member and being fixedly attached at each end of said bungie cord to the respective forward legs of said A-frame, thereby providing means to attach said backboard and hoop assembly to a free-standing A-frame.

9. A backboard and hoop assembly as described in claim 1 wherein the top horizontal portion of said frame member is disposed below a swimming pool diving board and the cross bar of said frame member is disposed above said swimming pool diving board and said backboard and hoop assembly further includes a bungie cord disposed about said diving board having the ends of said bungie cord fixedly attached to the engagement loop of said frame member, thereby providing means to attach said backboard and hoop assembly to a swimming pool diving board.

10. In combination with a basketball backboard and a netted hoop, said hoop being fixedly attached to the front face of said backboard, a substantially square tubular frame member having a top horizontal portion, a bottom horizontal portion, respective vertical side portions, a cross bar extending horizontally between said side portions between said top portion and said bottom portion, and an engagement loop fixedly attached to said top horizontal portion, said tubular frame member being pivotally and fixedly attachable to the rear face of said backboard in selective angular disposition by attachment of said bottom horizontal member to said backboard, and means to attach said frame member to a structure.

11. In combination with a basketball backboard and a netted hoop, said hoop being fixedly attached to the front face of said backboard, a substantially square tubular frame member having a top horizontal portion, a bottom horizontal portion, respective vertical side portions, a cross bar extending horizontally between said side portions between said top portion and said bottom portion, and an engagement loop fixedly attached to said top horizontal portion, said tubular frame member being pivotally and fixedly attachable to the rear face of said backboard in selective angular disposition by attachment of said bottom horizontal member to said backboard;

a cross bar clip fixedly attached to the rear face of said backboard which selectively engage the cross bar of said frame member in snap-fit engagement; and means to attach said frame member to a structure.

* * * * *